US011910846B2

(12) United States Patent
Stanton et al.

(10) Patent No.: US 11,910,846 B2
(45) Date of Patent: Feb. 27, 2024

(54) MULTIPURPOSE PUMPING AND NURSING GARMENTS

(71) Applicant: BRAVADO HOLDING AG, Zug (CH)

(72) Inventors: Lisa Stanton, Toronto (CA); Lindsay Spinler, Toronto (CA)

(73) Assignee: BRAVADO HOLDING AG, Zug (CH)

( * ) Notice: Subject to any disclaimer, the term of this patent is extended or adjusted under 35 U.S.C. 154(b) by 918 days.

(21) Appl. No.: 15/929,487

(22) Filed: May 5, 2020

(65) Prior Publication Data

US 2021/0345690 A1 Nov. 11, 2021

(51) Int. Cl.
*A41C 3/04* (2006.01)

(52) U.S. Cl.
CPC ..... *A41C 3/04* (2013.01)

(58) Field of Classification Search
CPC ..... A41C 3/04; A41D 1/215
USPC ..... 450/36, 18, 59, 60; 2/104
See application file for complete search history.

(56) References Cited

U.S. PATENT DOCUMENTS

| | | | | |
|---|---|---|---|---|
| 321,384 A | | 6/1885 | Presley | |
| 1,948,076 A | | 2/1934 | Notes | |
| 2,440,466 A | * | 4/1948 | Freedman | A41C 3/10 450/55 |
| 2,679,048 A | | 5/1954 | Alberts | |
| 2,738,509 A | | 3/1956 | Bauder | |
| D206,854 S | | 2/1967 | Sachs | |
| D207,390 S | | 4/1967 | Sachs | |
| 3,507,285 A | | 4/1970 | Williams | |
| 4,564,015 A | | 1/1986 | Friedman | |
| 4,660,227 A | | 4/1987 | Abramson | |
| 4,667,345 A | | 5/1987 | Jachowski | |
| 4,911,677 A | | 3/1990 | White | |

(Continued)

FOREIGN PATENT DOCUMENTS

| | | |
|---|---|---|
| AU | 2011100651 A4 | 7/2011 |
| CA | 2688737 C | 2/2014 |

(Continued)

OTHER PUBLICATIONS

International Application No. PCT/IB2021/053215, International Search Report and Written Opinion, dated Jul. 9, 2021.

(Continued)

*Primary Examiner* — Grace Huang
(74) *Attorney, Agent, or Firm* — MARSHALL, GERSTEIN & BORUN LLP

(57) ABSTRACT

A multipurpose nursing and pumping garment provides a nursing woman with a convenient way to both nurse and breast pump milk. The garment includes a first covering and a second covering arranged to form a surplice neckline. The length of a neckline edge of each covering provides freedom to move the first neckline edge from a covered position in which a wearer wears the first covering over a breast to a nursing position in which the wearer wears the first covering underneath the breast. Each covering is further provided with an aperture through which a breast shield may be inserted to pump milk. In some arrangements, each covering includes a lateral piece having a lateral edge and a medial piece having a medial edge. Each lateral edge and medial edge has bound and unbound portions. The aperture for each covering is created between each lateral edge and each medial edge.

6 Claims, 11 Drawing Sheets

(56) References Cited

U.S. PATENT DOCUMENTS

| | | | | |
|---|---|---|---|---|
| 5,034,999 | A | 7/1991 | Lubbers | |
| D321,273 | S | 11/1991 | Hull | |
| 5,086,511 | A | 2/1992 | Kobayashi et al. | |
| 5,514,166 | A | 5/1996 | Silver et al. | |
| 5,575,768 | A | 11/1996 | Lockridge et al. | |
| 5,697,830 | A | 12/1997 | White | |
| 5,848,439 | A | 12/1998 | Huseth et al. | |
| 6,004,186 | A | 12/1999 | Penny | |
| 6,178,784 | B1 | 1/2001 | Marley, Jr. | |
| 6,213,840 | B1 | 4/2001 | Han | |
| 6,227,936 | B1 | 5/2001 | Mendoza | |
| 6,346,027 | B1 | 2/2002 | Merkovsky | |
| 6,440,100 | B1 | 8/2002 | Prentiss | |
| 6,645,041 | B2 | 11/2003 | Sarensen | |
| 6,821,185 | B1 | 11/2004 | Francis | |
| 6,855,029 | B2 | 2/2005 | Rothman | |
| 6,866,558 | B2 | 3/2005 | Luciano et al. | |
| D505,243 | S | 5/2005 | Thunstedt | |
| 6,887,217 | B1 | 5/2005 | Logan | |
| 6,974,361 | B2 | 12/2005 | Cravaack et al. | |
| 7,028,509 | B2 | 4/2006 | Mitchell et al. | |
| 7,051,557 | B2 | 5/2006 | Mitchell et al. | |
| D523,212 | S | 6/2006 | Iourina | |
| 7,081,034 | B1 | 7/2006 | Zoellner | |
| D550,368 | S | 9/2007 | Hankins | |
| D571,529 | S | 6/2008 | Cook | |
| 7,395,556 | B2 | 7/2008 | Eraca | |
| 7,430,883 | B2 | 10/2008 | Sorensen | |
| 7,448,090 | B2 | 11/2008 | Lucock | |
| 7,549,302 | B2 | 6/2009 | Duckham et al. | |
| 7,611,399 | B2 | 11/2009 | Brigham | |
| 7,654,115 | B2 | 2/2010 | Duckham et al. | |
| 7,662,019 | B2 | 2/2010 | Faircloth et al. | |
| D625,487 | S | 10/2010 | Hendrickson | |
| 7,811,248 | B2 | 10/2010 | Bjorge | |
| 7,878,880 | B2 | 2/2011 | Hendrickson | |
| D638,196 | S | 5/2011 | Torres | |
| 7,950,980 | B2 | 5/2011 | Solberg et al. | |
| D641,132 | S | 7/2011 | Sharard | |
| 8,057,452 | B2 | 11/2011 | Fialkoff | |
| 8,137,153 | B2 * | 3/2012 | Bell | A61M 1/067 604/74 |
| 8,192,247 | B2 * | 6/2012 | Abbaszadeh | A61M 1/067 2/104 |
| 8,226,452 | B2 | 7/2012 | Hendrickson | |
| 8,323,070 | B2 * | 12/2012 | Abbaszadeh | A61M 1/062 604/74 |
| 8,414,353 | B1 | 4/2013 | Leavell | |
| 8,469,770 | B2 * | 6/2013 | Alva | A41C 3/04 450/36 |
| 8,523,629 | B2 * | 9/2013 | Pundyk | A41C 3/0057 450/36 |
| 8,668,547 | B2 * | 3/2014 | Boonen | A41C 3/02 450/36 |
| 8,690,634 | B2 | 4/2014 | Heath et al. | |
| 9,113,660 | B2 | 8/2015 | Op't Hof | |
| 9,155,339 | B2 | 10/2015 | Alva | |
| 9,167,855 | B2 | 10/2015 | Abbaszadeh | |
| D744,718 | S | 12/2015 | Randall | |
| D749,296 | S | 2/2016 | Gamble | |
| 9,402,425 | B2 * | 8/2016 | Cortese | A41C 3/04 |
| D769,576 | S | 10/2016 | Kawasaki | |
| 9,498,005 | B2 | 11/2016 | Abbaszadeh | |
| 9,538,795 | B2 | 1/2017 | Cobb | |
| 9,578,901 | B2 * | 2/2017 | Randall | A41C 3/02 |
| 9,629,396 | B2 | 4/2017 | Alva | |
| 9,706,796 | B2 | 7/2017 | Kawasaki | |
| D799,786 | S | 10/2017 | Hoth | |
| 9,872,524 | B2 | 1/2018 | Abbaszadeh | |
| D810,397 | S | 2/2018 | Beroff | |
| 9,894,942 | B2 | 2/2018 | Burrell | |
| 10,212,972 | B2 | 2/2019 | Abbaszadeh | |
| 10,231,491 | B2 | 3/2019 | Akerson et al. | |
| 10,238,153 | B2 | 3/2019 | Alva | |
| D854,782 | S | 7/2019 | Ironi | |
| 10,405,587 | B2 | 9/2019 | Cortese et al. | |
| 10,420,377 | B2 | 9/2019 | Abbaszadeh | |
| 10,420,378 | B2 * | 9/2019 | Kosak | A41F 1/006 |
| D861,286 | S | 10/2019 | Ye | |
| 10,426,203 | B2 | 10/2019 | Kosak | |
| 10,441,002 | B2 * | 10/2019 | Ironi | A41C 3/04 |
| 10,463,082 | B2 | 11/2019 | Boele et al. | |
| D871,718 | S | 1/2020 | Pan | |
| 10,772,361 | B2 * | 9/2020 | Abbaszadeh | A61M 1/062 |
| 10,786,018 | B2 * | 9/2020 | Fletcher | A41C 3/12 |
| 11,241,048 | B2 * | 2/2022 | Alva | A41C 3/0035 |
| 11,419,368 | B2 * | 8/2022 | Schnadt | A41C 3/0071 |
| 2003/0027491 | A1 | 2/2003 | Cravaack et al. | |
| 2003/0191427 | A1 | 10/2003 | Jay et al. | |
| 2003/0199224 | A1 | 10/2003 | Luciano et al. | |
| 2004/0016039 | A1 | 1/2004 | Caprio | |
| 2007/0161330 | A1 | 7/2007 | Whitehead et al. | |
| 2008/0034462 | A1 | 2/2008 | Ekelund et al. | |
| 2008/0034463 | A1 | 2/2008 | Ekelund et al. | |
| 2008/0201817 | A1 | 8/2008 | Ostrander | |
| 2009/0083895 | A1 | 4/2009 | Pellegrini et al. | |
| 2010/0031418 | A1 | 2/2010 | Op't Hof | |
| 2010/0088800 | A1 | 4/2010 | Pate-Gurule | |
| 2010/0159802 | A1 | 6/2010 | Abbaszadeh | |
| 2010/0185144 | A1 | 7/2010 | Bell | |
| 2011/0104985 | A1 | 5/2011 | Linder et al. | |
| 2011/0314587 | A1 | 12/2011 | Ritchie | |
| 2013/0122780 | A1 | 5/2013 | McCall | |
| 2013/0232661 | A1 * | 9/2013 | Huntley | A41D 1/215 2/104 |
| 2013/0273809 | A1 | 10/2013 | Turk et al. | |
| 2014/0087625 | A1 | 3/2014 | Ironi | |
| 2014/0248822 | A1 | 9/2014 | Abbott et al. | |
| 2014/0273737 | A1 | 9/2014 | Cortese et al. | |
| 2014/0364036 | A1 | 12/2014 | Abbaszadeh | |
| 2015/0133028 | A1 | 5/2015 | Applewhite | |
| 2015/0264982 | A1 | 9/2015 | Randall et al. | |
| 2016/0015091 | A1 * | 1/2016 | Hendrickson | A41D 1/215 2/104 |
| 2016/0021940 | A1 | 1/2016 | Carney | |
| 2016/0029139 | A1 * | 1/2016 | Lee | G10L 19/008 381/17 |
| 2016/0331045 | A1 | 11/2016 | Cortese et al. | |
| 2017/0042256 | A1 | 2/2017 | Kawasaki | |
| 2018/0103691 | A1 | 4/2018 | Alva | |
| 2018/0132542 | A1 | 5/2018 | Abbaszadeh | |
| 2019/0014829 | A1 * | 1/2019 | Kim | A41F 15/002 |
| 2019/0037931 | A1 | 2/2019 | Akerson et al. | |
| 2019/0261698 | A1 | 8/2019 | Akerson et al. | |
| 2019/0289926 | A1 | 9/2019 | Abbaszadeh | |
| 2020/0154793 | A1 | 5/2020 | Kosak | |

FOREIGN PATENT DOCUMENTS

| | | | | |
|---|---|---|---|---|
| CN | 209498610 | U | 10/2019 | |
| EP | 1543736 | A1 | 6/2005 | |
| EP | 2810572 | A1 | 12/2014 | |
| EP | 2810573 | A1 | 12/2014 | |
| EP | 3143886 | A1 | 3/2017 | |
| GB | 2287640 | A * | 9/1995 | A41C 3/04 |
| GB | 2536541 | A | 9/2016 | |
| KR | 200424000 | Y1 * | 8/2006 | A41C 3/04 |
| KR | 2011-0001216 | U | 2/2011 | |
| WO | WO-96/22116 | A1 | 7/1996 | |
| WO | WO-2008/051484 | A2 | 5/2008 | |
| WO | WO-2013/180644 | A1 | 12/2013 | |
| WO | WO-2018/136640 | A1 | 7/2018 | |

OTHER PUBLICATIONS

Arden All in One Nursing and Handsfree Pumping Bra, retrieved from the Internet at: https://shop.thedairyfairy.com/arden-all-in-one-nursing-and-handsfree-pumping-bra/ Mar. 9, 2013.

Hands-free Breast Pumping, by Amiga500, posted online at: <https://www.instructables.com/id/Hands-free-breast-pumping/>, Mar. 11, 2011.

(56) References Cited

OTHER PUBLICATIONS

La Leche League Hands-Free Padded Pump Bra 4106, retrieved from the Internet at: <http://www.birthandbaby.com/shop/products/1544> Apr. 7, 2012.

Medela Easy Expression Hands-Free Bustier,posted at amazon.com <http://amazon.com>, earliest date available Aug. 6, 2007, [online], acquired on Apr. 29, 2016. Available from Internet, <URL: <http://www.amazon.com/Medela-Expression-Hands-Free-Bustier-Medium/dp/B002NUWQUM/ref=cm_cr_arp_dproduct_top?ie=UTF8>.

Organic Pump Ease, posted at mothersboutique.com <http://mothersboutique.com>, earliest date available Jul. 3, 2010, [online], acquired on Mar. 30, 2016. Available from Internet, <URL: <http://www.mothersboutique.com/orpuea.html>.

Product Review: The Arden Bra by The Dairy Fairy, Retrieved from the Internet at: <https://www.binxbaby.com/product-review-the-arden-bra-by-the-dairy-fairy/>, May 15, 2013.

Rumina Hands-Free Pump & Nurse; Tank, retrieved from the Internet at: <https://mommygear.com/rumina-hands-free-pump-nurse-tank.htm>, Mar. 29, 2013.

Simple Wishes Hands Free Breast Pumping Bra, posted at mothersboutique.com <http://mothersboutique.com>, earliest date available Sep. 18, 2010, [online], acquired on Mar. 30, 2016. Available from Internet, <URL: <http://www.mothersboutique.com/simplewishesl.html>>.

The Dairy Fairy Arden All-in-One Nursing and Pumping Bra Review, The Measuring Flower Blog, retrieved from the Internet at: <https://measuringflower.com/dairy-fairy/> (2013).

* cited by examiner

MULTIPURPOSE PUMPING AND NURSING GARMENTS

FIELD OF THE DISCLOSURE

This disclosure relates generally to multipurpose garments for a nursing woman to facilitate breastfeeding an infant directly and using a breast pump to extract milk for storage and subsequent feeding of an infant.

BACKGROUND

Breastfeeding of an infant provides numerous benefits to the infant and the breastfeeding woman. Breastmilk contains all of the nutrients a baby needs in the exact amounts required for optimal growth and development. Breastfed babies are healthier, having, for example, fewer ear infections. For the breastfeeding woman, breastfeeding reduces post-delivery bleeding and chances of anaemia, aids in the uterus returning to its original size after birth, and burns up to an extra 500 calories per day.

A nursing woman can provide breastmilk to an infant in two ways. First, the nursing woman can breastfeed the infant directly. Breastfeeding the infant directly requires that the infant's mouth latches properly onto the breastfeeding woman's breast. Achieving a good latch can be challenging, requiring proper positioning of the infant and breast. In some instances, the nursing woman must manually manipulate her breast with one hand to achieve a shape that is easier for the infant to latch onto while holding the infant with her other hand. Material from a bra or nursing garment coming between the infant and the breast makes direct breastfeeding more challenging, as does having to hold the bra or nursing garment out of the way during breastfeeding.

Second, a nursing woman can use a breast pump to extract and store milk for feeding an infant by a bottle. Breast pump systems routinely include a breast shield, which is a funnel-like apparatus having a conical region that is placed against the breast with the nipple in the center of the breast shield. Upon the application of negative pressure, the nipple is drawn toward, and often into, a tubular portion of the breast shield known as the nipple tunnel. The nipple tunnel of the breast shield is connected to other components of a breastmilk collection kit. This connection permits application of intermittent (i.e., cyclical) negative pressure to the interior of the breast shield, and also provides a flow path for breastmilk expressed into the nipple tunnel to be collected in a collection receptacle. The collection receptacle may be a breastmilk container having a threaded cap that can serve as a bottle for feeding an infant. A nursing woman generally has to hold the breast shield against her breast manually in order to pump milk. Predictably, holding the breast shield in place is inconvenient and limits the tasks that the woman could otherwise accomplish while pumping.

Many nursing women provide breastmilk to an infant through both direct breastfeeding and by pumping milk for later use. In a single day, a nursing woman may sometimes opt to directly breastfeed and may other times opt to pump milk. For example, a nursing woman with a job outside the home may opt to breastfeed when she is at home with her infant and may opt to pump milk when she is away at work. Nursing women also have a significant portion of their day when they are not directly breastfeeding or pumping milk. For the portion of their day that is unrelated to nursing, a garment that provides the typical aesthetic and support of a non-nursing, non-pumping bra is desirable. Although various garments have been developed to facilitate nursing and breast pumping, most are intended to support either nursing or breast pumping as opposed to both nursing and breast pumping. As a result, nursing women are forced to change between garments. Further, many of the garments do not offer a normal appearance under clothing for the times when breastfeeding or pumping are not being performed. For nursing women, constantly having to change garments is tedious and burdensome.

SUMMARY

Multipurpose pumping and nursing garments are hereby disclosed. The garments have a first covering for a first breast and a second covering for a second breast. The first covering and the second covering are configured to move from a covered position over their respective breasts to a nursing position under their respective breasts. In this way, the garments support nursing. The first covering and the second covering also each include apertures formed by medial and lateral pieces. The apertures permit the insertion of breast shields while the garment is being worn, and the first covering and the second covering support the breast shields in place during milk extraction. In this way, the garments support breast pumping. Further, the medial and lateral pieces of the first covering and the second covering are configured to lay flat with no visible aperture in the covered position. In this way, the garments provide the aesthetic and support of a non-nursing bra or bustier.

Two arrangements of garments are disclosed. Although disclosed as separate arrangements, the features and aspects of each garment are considered interchangeable. Permutations of either garment are considered within the scope of this disclosure. Further, certain aspects or features may be omitted from either garment. For example, the garments described below include two bra straps. However, garments that are strapless or include only one bra strap are considered within the scope of this disclosure. Similarly, typical bra features, such as hook and eye clasps at the back of a bottom band of a bra, may be added or omitted as desired.

In both arrangements, a garment includes a bottom band configured to wrap around the body of a nursing woman and a first bra strap and a second bra strap configured to extend over respective shoulders of the nursing woman to hold the garment in place. The first bra strap and the second bra strap may be integral with other components of the garment or may be separate and connected to other components of the garment. Optionally, a back may be connected to the bottom band and connected to or integral with the first and second bra straps and configured to cover a portion of a back of the nursing woman. Both arrangements further include a first covering configured to cover a first breast of the nursing woman and a second covering configured to cover a second breast of the nursing woman.

The first arrangement includes an interior panel connected to the bottom band, the first bra strap, and the second bra strap. The first covering and the second covering are part of the interior panel. The first arrangement further includes an exterior panel that is permanently connected to the bottom band. The exterior panel is selectively connectable to the first bra strap and the second bra strap, meaning that the exterior panel may be connected and disconnected from the first bra strap and the second bra strap. In this way, the exterior panel may selectively cover the interior panel. During nursing or pumping, the exterior panel may be pulled down to expose the interior panel. At other times, the exterior panel may be connected to the first bra strap and the second bra strap so as to cover the interior panel.

When covering the interior panel, the exterior panel provides additional warmth and coverage of the breasts and provides another layer that prevents any leaking milk from reaching the clothing of the wearer.

The second arrangement does not include an exterior panel. Instead, the breasts of the wearer are covered only by the first covering and the second covering. The second arrangement provides the benefit of being less bulky and cooler. Further, the second arrangement does not require a nursing mother to fuss with any clips or attachments at the bra strap in order to expose a breast for breastfeeding.

Specifically, the apertures in the first and second coverings are formed by medial and lateral pieces. Each covering includes a medial piece and a lateral piece. The medial piece in each covering has a medial or internal edge. A portion of the medial or internal edge is bound (i.e., sewn or otherwise connected to another piece of material) while another portion of the medial or internal edge is unbound (i.e., now sewn or otherwise connected to another piece of material). The lateral piece in each covering have a lateral or inner edge. A portion of the lateral or inner edge is bound and another portion of the lateral or inner edge is unbound. In particular, the bound portion of the medial or internal edge is adjacent to the bound portion of the lateral or inner edge, and the adjacent bound portions are bound together such that they are connected by, for example, sewing, adhesive, or other techniques. In the first arrangement, the unbound portion of the medial edge extends across the lateral piece, and the unbound portion of the lateral edge extends across the medial piece, such that the medial piece and the lateral piece overlap at the aperture. In the second arrangement, the unbound portion of the internal edge and the unbound portion of the inner edge are adjacent but unconnected.

Each of the first covering and the second covering may include a neckline edge and an armpit edge. In the first arrangement, for each covering, the unbound portion of the medial edge may extend to the armpit edge. Further, in the first arrangement, the unbound portion of the lateral edge may extend to the neckline edge. For each covering of the first arrangement, an area of the medial piece adjacent the unbound portion of the medial edge overlaps an area of the lateral piece adjacent the unbound portion of the lateral edge to form an overlapping region. The area of the medial piece and the area of the lateral piece in the overlapping region lay adjacent to one another in a covered position such that the aperture is not visible. In a pumping position, area of the medial piece and the area of the lateral piece in the overlapping region move relative to one another to permit insertion of a breast shield through the aperture.

In both the first arrangement and the second arrangement, the bound portion of the medial or internal edge and the bound portion of the lateral or inner edge may be located between the neckline edge and the armpit edge. A bar tack may be provided at the bottom of the aperture to reinforce this area of the garment, which may be subject to stress or additional wear as a breast shield is inserted and removed through the aperture. Specifically, the bar tack may be provided where the bound portion of the lateral or inner edge and the bound portion of the medial or internal edge end and the unbound portion of the lateral or inner edge and the unbound portion of the medial or internal edge begin.

In both the first arrangement and the second arrangement, the first covering and the second covering are arranged to form a surplice neckline. Each covering is integral with or permanently affixed to a bra strap. A neckline edge of each covering extends from a bra strap to the bottom band. Each neckline edge has a length that provides freedom of motion to move the first neckline edge from a covered position in which a wearer wears the covering over a breast to a nursing position in which the wearer wears the covering underneath the breast. In essence, the neckline edge is configured to allow a wearer to pull the neckline edge beneath a breast in order to expose the breast for breastfeeding an infant. Elastic may be sewn into each neckline edge to provide additional flexibility, resilience, and range of motion. In the first arrangement, the exterior panel may be configured to cover the neckline edge of each covering.

Referring now to the neckline edge of the first covering as the first neckline edge and the neckline edge of the second covering as the second neckline edge, the first neckline edge connects to the bottom band at a first location and the second neckline edge connects to the bottom band at a second location. The first neckline edge crosses over the second neckline edge at a neckline intersection. A central overlap region in the first covering and in the second covering is created between the first location, the second location, and the neckline intersection. The locations where the neckline edges attach to the bottom band are important in part because the locations are one factor determining the length of each neckline edge. As discussed above, the length of the neckline edge is important to achieving a nursing position. The length of the neckline edge must be long enough to have the necessary play for the required movement of the neckline edge.

The locations where the neckline edges attach to the bottom band are also important because they define where an neckline edge will fall against the body of a wearer. If the distance between the first location and the second location is great, the first covering may cover part of the second breast in addition to covering the first breast. Likewise, the second covering may cover part of the first breast in addition to covering the second breast. This is not inherently problematic. However, when a breast shield is inserted through an aperture, the breast shield needs to make sealing contact with the breast in order for the negative pressure needed to pump milk to occur. If a covering extends too far over the opposite breast, the covering may interfere with the sealing contact between the breast and the breast shield. Put another way, each covering includes a breast shield support area surrounding an aperture. The central overlap region in the first covering and the second covering should not intersect a breast shield support area. Having the first location and second location be medial to the bound portion of the medial and lateral pieces of each covering helps to ensure that the central overlap region will not interfere with sealing contact between a wearer and a breast shield when pumping.

DETAILED DESCRIPTION OF THE DRAWINGS

Figure 1:
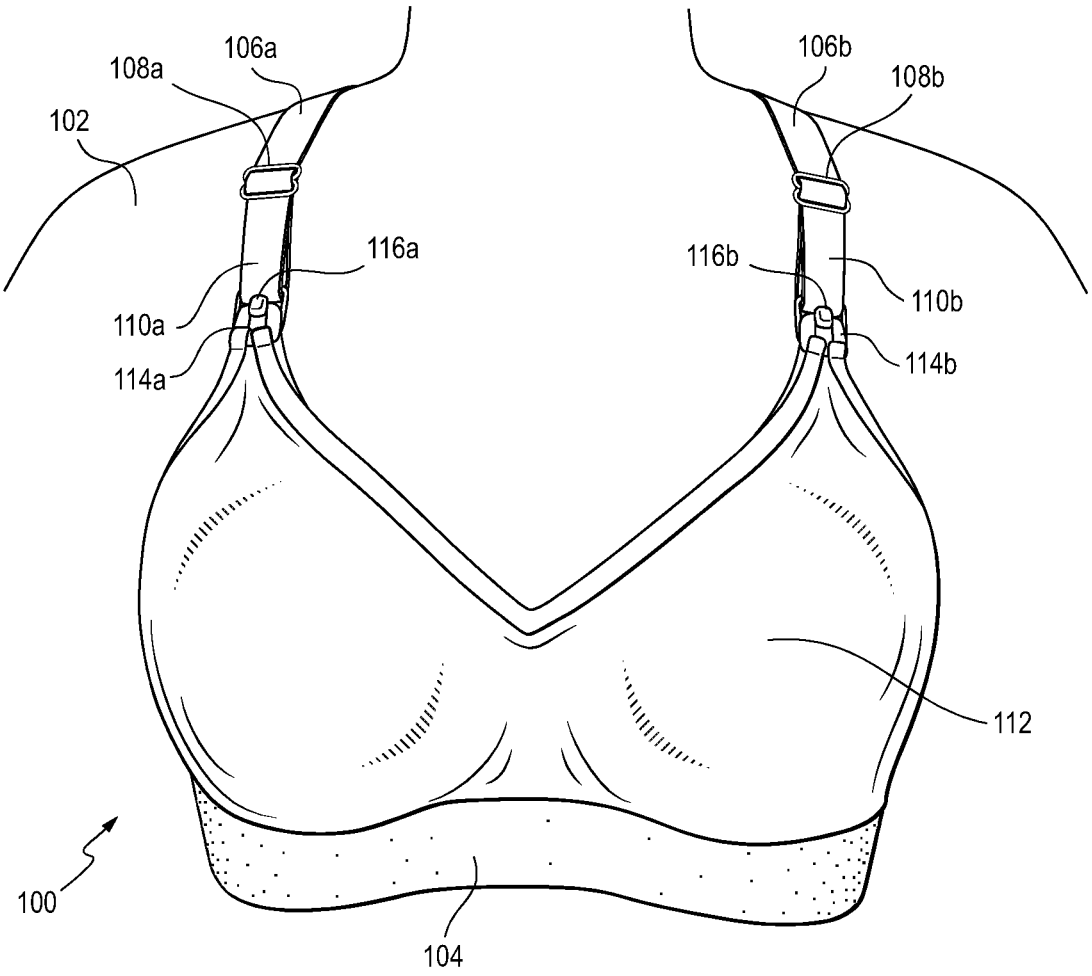
FIG. 1 is a perspective view of a first arrangement of a multipurpose nursing and pumping garment on a wearer with an exterior panel connected to bra straps of the garment.

FIG. 1 illustrates a multipurpose pumping and nursing garment 100 worn by a wearer 102. The garment 100 covers the breasts of the wearer 102. A bottom band 104 is configured to wrap around the body of the wearer 102 below the breasts of the wearer 102. The bottom band 104 may be formed from a material having a relatively low modulus of elasticity relative to other material forming the garment 100. The elasticity of the bottom band 104 may allow it to stretch to be pulled over the head and the breasts of the wearer 102 while still allowing the bottom band 104 to fit snugly when positioned below the breasts. The bottom band 104 is depicted herein as being a continuous band that requires that the garment 100 be put on over the head of the wearer 102. However, the bottom band 104 may alternately include a front or back clasp, hook, or other connection mechanism that allows the garment 100 to instead be put on by wrapping around the body of the wearer 102 in an unfastened state before being fastened.

The garment 100 further includes a first bra strap 106*a* and a second bra strap 106*b*. The first bra strap 106*a* is configured to extend over a first shoulder of the wearer 102 and the second bra strap 106*b* is configured to extend over a second shoulder of the wearer 102. The bra straps 106*a* and 106*b* may be adjustable in length to allow the wearer 102 to achieve proper support from the garment 100. Specifically, the bra strap 106*a* may include a slider 108*a* and the bra strap 106*b* may include a slider 108*b*. A portion 110*a* of the bra strap 106*a* and/or a portion 110*b* of bra strap 106*b* may be doubled over in order to achieve a certain length. The sliders 108*a* and 108*b* allow adjustment of the length of the doubled over portions 110*a* and 110*b*, respectively, and hold the doubled over portions 110*a* and 110*b*, respectively, in place when the adjustment is complete. Adjustability of the bra strap 106*a* and the bra strap 106*b* is a beneficial feature for a nursing and pumping garment because the size of the breasts of the wearer 102 may regularly fluctuate depending upon the presence or absence of milk within the breasts. Further, during pumping, adjusting the bra strap 106*a* and/or the bra strap 106*b* to be longer may allow the garment 100 to better position and support breast shields.

An exterior panel 112 is permanently connected to the bottom band 104. The exterior panel 112 is selectively connectable to the first bra strap 106*a* and the second bra strap 106*b*. Specifically, the exterior panel 112 may include a first ring 114*a* and a second ring 114*b*. The first bra strap 106*a* may include a first hook 116*a*, and the second bra strap 106*b* may include a second hook 116*b*. The first ring 114*a* of the exterior panel 112 may be configured to hook over the first hook 116*a* of the first bra strap 106*a* and the second ring 114*b* may be configured to hook over the second hook 116*b* of the second bra strap 106*b*. When the first ring 114*a* is hooked on the first hook 116*a* and the second ring 114*b* is hooked on the second hook 116*b*, as shown in FIG. 1, the exterior panel 112 covers an interior panel 118 not visible in FIG. 1 but shown in FIG. 2.

Figure 2:
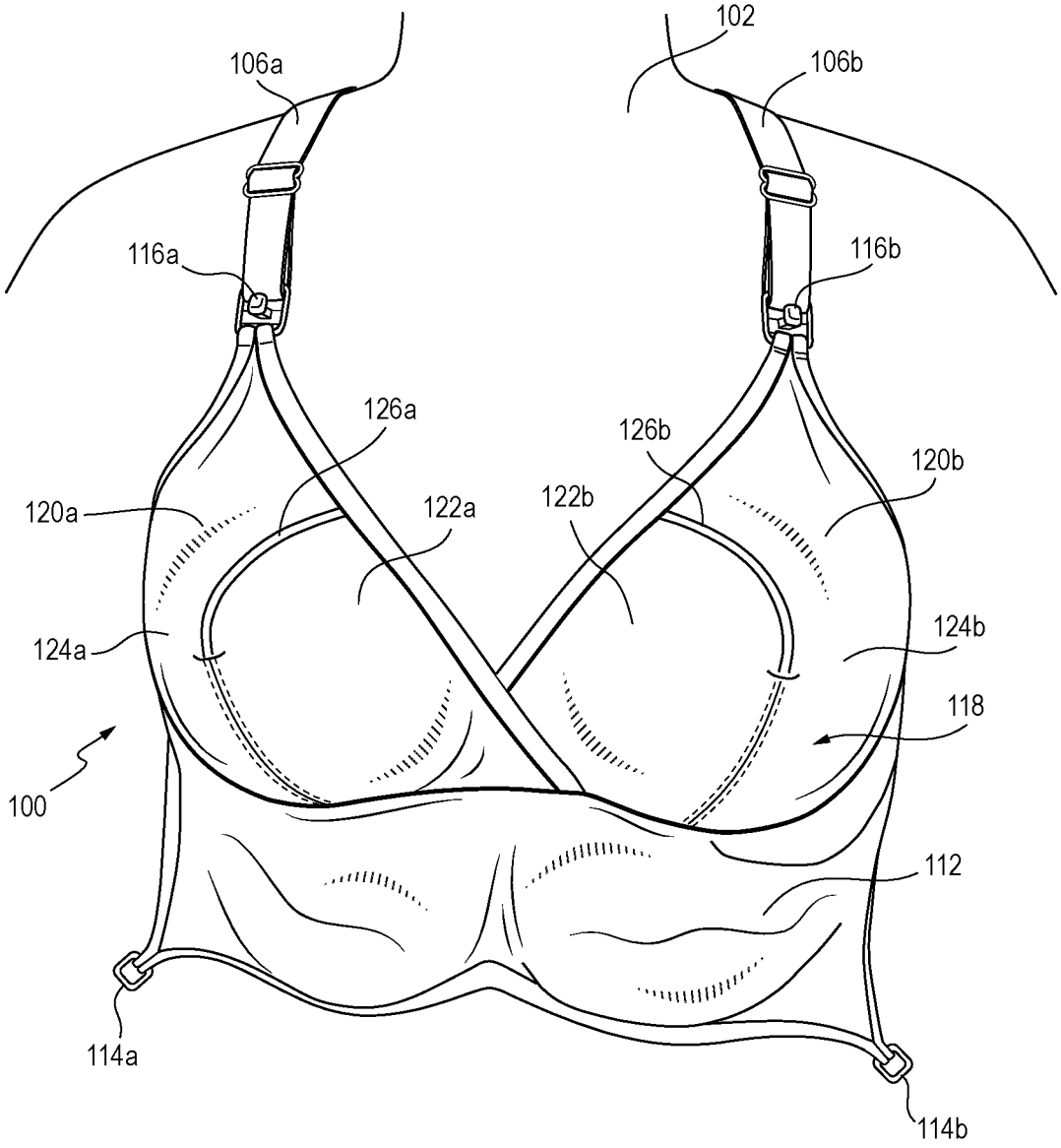
FIG. 2 is a perspective view of the garment of FIG. 1 on a wearer with the exterior panel disconnected from the bra straps and pulled down to shown an interior panel in a covered position.

FIG. 2 shows the exterior panel 112 when the exterior panel 112 is not connected to the first bra strap 106*a* and the second bra strap 106*b*. Specifically, the first ring 114*a* is unhooked from the first hook 116*a* and the second ring 114*b* is unhooked from the second hook 116*b*. As a result, the exterior panel 112 can be pulled down to expose the interior panel 118. The exterior panel 112 is still connected to the bottom band 104 (not shown) in this configuration.

The interior panel 118 is also connected to the bottom band 104 (not shown). In addition, the interior panel 118 is connected to the first bra strap 106*a* and the second bra strap 106*b*. The interior panel 118 includes a first covering 120*a* and a second covering 120*b*. The first covering 120*a* includes a first medial piece 122*a*, and the second covering 120*b* includes a second medial piece 122*b*. The first medial piece 122*a* and the second medial piece 122*b* are the pieces of the respective first covering 120*a* and second covering 120*b* visibly closest to the centerline of the body of the wearer 102 when the garment 100 is viewed from a front of the garment 100 (as shown in FIG. 2). The first covering 120*a* also includes a first lateral piece 124*a*, and the second covering 120*b* also includes a second lateral piece 124*b*. The first lateral piece 124*a* and the second lateral piece 124*b* are the pieces of the respective first covering 120*a* and second covering 120*b* visibly farthest from the centerline of the body of the wearer 102 when the garment 100 is viewed from a front of the garment 100 (as shown in FIG. 2).

The first covering 120*a* has a first aperture 126*a* between the first medial piece 122*a* and the first lateral piece 124*a*, and the second covering 120*a* has a second aperture 126*b* between the second medial piece 122*b* and the second lateral piece 124*b*. The first aperture 126*a* and the second aperture 126*b* are configured to support a breast shield during breast pumping, as discussed in greater detail below. When the interior panel 118 is in a covered position, as shown in FIG. 2, the first aperture 126*a* and 126*b* are not visible. That is, the openings through which breast shields may be inserted into the garment 100 cannot be seen in the covered position. All that is visible (and what is identified in FIG. 2 as the first aperture 126*a* and the second aperture 126*b*) is the locations between the lateral pieces 124*a* and 124*b* and the respective medial pieces 122*a* and 122*b* that are not sewn together that, with proper manipulation, will form the openings through which the breast shields may be inserted. This is beneficial because, as a result, the breasts of the wearer 102 also cannot be seen in a covered position. The first aperture 126*a* and the second aperture 126*b* are configured to lay flat with no exposure of the underlying breast when the wearer is not performing breast pumping.

Figure 3A:
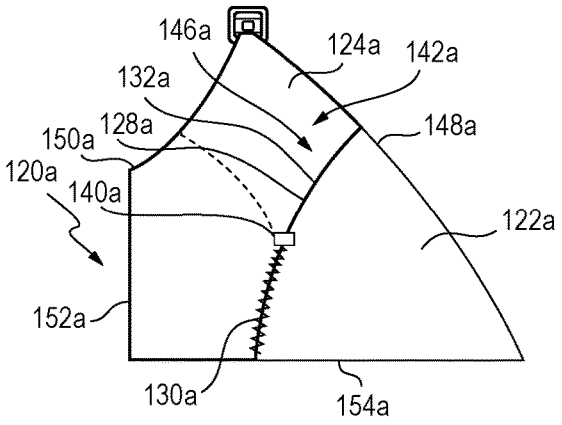
FIG. 3A is a front view of a first covering of the interior panel of the garment of FIGS. 1 and 2 showing the full shape of a first lateral piece of the first covering.
Figure 3B:
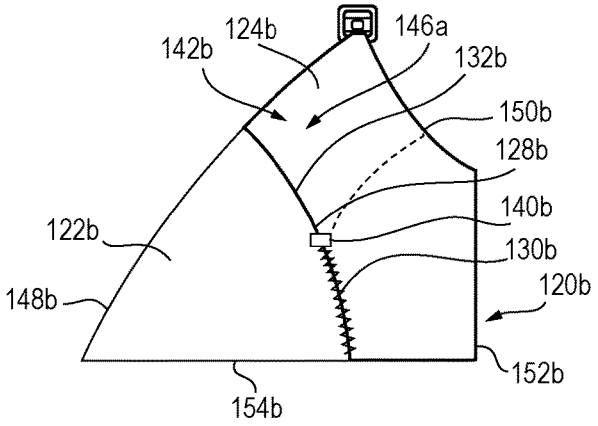
FIG. 3B is a front view of a second covering of the interior panel of the garment of FIGS. 1 and 2 showing the full shape of a second lateral piece of the second covering.

FIGS. 3A-3D provide a more detailed view of how the first medial piece 122*a* and the second medial piece 122*b* and first lateral piece 124*a* and the second lateral piece 124*b* are shaped and positioned to form the first aperture 126*a* and the second aperture 126*b*. FIGS. 3A and 3B show, respectively, the first covering 120*a* and the second covering 120*b* from a front view. The front view shows the exterior of the garment 100 that would be visible when a wearer 102 was wearing the garment 100 as in FIG. 2. In FIGS. 3A and 3B, the full shapes of the first lateral piece 124*a* and the second lateral piece 124*b* are visible. The first lateral piece 124*a* has a first lateral edge 128*a*, and the second lateral piece 124*b* has a second lateral edge 128*b*. The first lateral edge 128*a* and the second lateral edge 128*b* include, respectively, a bound portion 130*a* and a bound portion 130*b* that are sewn, adhered, or otherwise connected, respectively, to the first medial piece 122*a* and the second medial piece 122*b* (as shown schematically by the zig-zag line). The first lateral edge 128*a* and the second lateral edge 128*b* also include, respectively, an unbound portion 132*a* and an unbound portion 132*b* that create in part, respectively, the first aperture 126*a* and the second aperture 126*b* (shown in FIG. 2). The unbound portions 132*a* and 132*b* of the first lateral edge 128*a* and the second lateral edge 128*b*, respectively, extend across the first medial piece 122*a* and the second medial piece 122*b*, respectively.

Figure 3C:
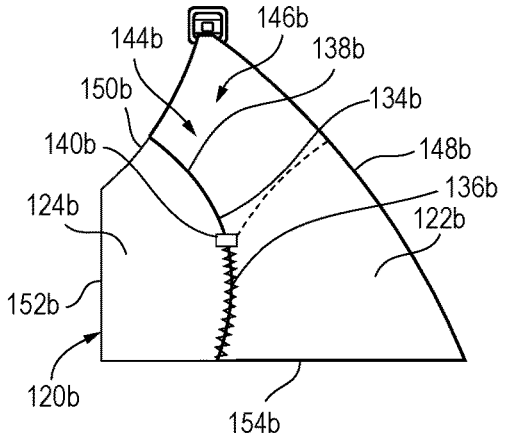
FIG. 3C is a back view of the second covering of the interior panel of the garment of FIGS. 1 and 2 showing the full shape of a second medial piece of the second covering.
Figure 3D:
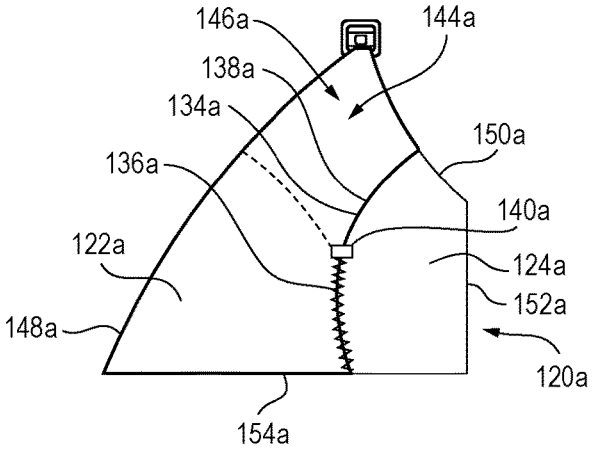
FIG. 3D is a back view of the first covering of the interior panel of the garment of FIGS. 1 and 2 showing the full shape of a first medial piece of the first covering.

FIGS. 3C and 3D show, respectively, the second covering 120*b* and the first covering 120*a* from a back view. The back view shows the interior of the garment 100 that would be visible if the garment 100 were flipped inside out. In FIGS. 3C and 3D, the full shapes of the first medial piece 122*a* and the second medial piece 122*b* are visible. The first medial piece 122*a* has a first medial edge 134*a*, and the second medial piece 122*b* has a second medial edge 134*b*. The first medial edge 134*a* and the second medial edge 134*b* include, respectively, a bound portion 136*a* and a bound portion 136*b* that are sewn, adhered, or otherwise connected, respectively, to the first lateral piece 124*a* and the second lateral piece 124*b*. The first medial edge 134*a* and the second medial edge 134*b* also include, respectively, an unbound portion 138*a* and an unbound portion 138*b* that create in part, respectively, the first aperture 126*a* and the second aperture 126*b*. The unbound portions 138*a* and 138*b* of the first medial edge 134*a* and the second medial edge 134*b*, respectively, extend across the first lateral piece 124*a* and the second lateral piece 124*b*, respectively.

As shown in FIGS. 3A-3D, the bound portion 136*a* of the first medial edge 134*a* is adjacent and connected to the bound portion 130*a* of the first lateral edge 128*a*. Likewise, the bound portion 136*b* of the second medial edge 134*b* is adjacent and connected to the bound portion 130*b* of the second lateral edge 128*b*. The bound portion 136*a* is sewn, adhered, or otherwise fastened to the bound portion 130*a* such that the overlap between the first medial piece 122*a* and the first lateral piece 124*a* where the bound portion 136*a* is connected to the bound portion 130*a* is limited to only the amount of overlap needed to sew, adhere, or otherwise fasten the bound portions 136*a* and 130*a* to each other. Likewise, the bound portion 136*b* is sewn, adhered, or otherwise fastened to the bound portion 130*b* such that the overlap between the second medial piece 122*b* and the second lateral piece 124*b* is limited to only the amount of overlap needed to sew, adhere, or otherwise fasten the bound portions 136*b* and 130*b* to each other.

As shown in FIGS. 3A and 3D, a first bar tack 140*a* may be provided where the bound portion 136*a* of the first medial edge 134*a* and the bound portion 130*a* of the first lateral edge 128*a* end and the unbound portion 138*a* of the first medial edge 134*a* and the unbound portion 132*a* of the first lateral edge 128*a* begin. As shown in FIGS. 3B and 3C, a second bar tack 140*b* may be provided where the bound portion 136*b* of the second medial edge 134*b* and the bound portion 130*b* of the second lateral edge 128*b* end and the unbound portion 138*b* of the second medial edge 134*b* and the unbound portion 132*b* of the second lateral edge 128*b* begin. The first bar tack 140*a* and the second bar tack 140*b* may resist stress and wear caused from breast shields being inserted, supported, and removed from, respectively, first aperture 126*a* and second aperture 126*b*.

As shown in FIGS. 3A and 3B, respectively, an area 142*a* of the first lateral piece 124*a* is adjacent the unbound portion 132*a* of the first lateral edge 128*a*, and an area 142*b* of the second lateral piece 124*b* is adjacent the unbound portion 132*b* of the second lateral edge 128*b*. As shown in FIGS. 3C and 3D, respectively, an area 144*a* of the first medial piece 122*a* is adjacent the unbound portion 136*a* of the first medial edge 134*a*, and an area 144*b* of the second medial piece 122*b* is adjacent the unbound portion 136*b* of the second medial edge 136*b*. As shown by looking at both FIGS. 3A and 3D, the area 144*a* of the first medial piece 122*a* overlaps the area 142*a* of the first lateral piece 124*a* to form an overlapping region 146*a* of the first covering 120*a*. As shown by looking at both FIGS. 3B and 3C, the area 144*b* of the second medial piece 122*b* overlaps the area 142*b* of the second lateral piece 124*b* to form an overlapping region 146*b* of the second covering 120*b*. The areas 142*a* and 144*a* lay adjacent to one another when the first covering 120*a* is in a covered position such that the first aperture 126*a* is not visible in the covered position, as discussed with respect to FIG. 2 above. Likewise, the areas 142*b* and 144*b* lay adjacent to one another when the second covering 120*b* is in a covered position such that the second aperture 126*b* is not visible in the covered position, as discussed with respect to FIG. 2 above.

As shown in FIGS. 3A and 3D, the first covering 120*a* includes a first neckline edge 148*a*, a first armpit edge 150*a*, a side edge 152*a*, and a bottom edge 154*a* that define the outer parameters and overall shape of the first covering 120*a*. Each of the first neckline edge 148*a*, the first armpit edge 150*a*, the side edge 152*a*, and the bottom edge 154 may be formed by the first medial piece 122*a*, the first lateral piece 124*a*, or a combination of both the first medial piece 122*a* and the first lateral piece 124*a*. As shown in FIGS. 3B and 3C, the second covering 120*b* includes a second neckline edge 148*b*, a second armpit edge 150*b*, a side edge 152*b*, and a bottom edge 154*b* that define the outer parameters and overall shape of the second covering 120*b*. Each of the second neckline edge 148*b*, the second armpit edge 150*b*, the side edge 152*b*, and the bottom edge 154*b* may be formed by the second medial piece 122*b*, the second lateral piece 124*b*, or a combination of both the second medial piece 122*b* and the second lateral piece 124*b*. Although the first covering 120*a* and the second covering 120*b* are shown and described as having four edges, coverings with a different number of edges are also contemplated. For example, an armpit edge (such as armpit edge 150*a* or 150*b*) and side edge (such as side edge 152*a* or 152*b*) could be merged into a single edge. Alternately, additional edges could be added. For example, a neckline edge (such as neckline edge 148*a* or 148*b*) might be formed of multiple segments that together form the neckline edge.

In the arrangement shown in FIG. 3A, the unbound portion 132*a* of the first lateral edge 128*a* extends to the first neckline edge 148*a*. As shown in FIG. 3D, the unbound portion 138*a* of the first medial edge 134*a* extends to the first armpit edge 150*a*. As shown in FIG. 3B, the unbound portion 132*b* of the second lateral edge 128*b* extends to the second neckline edge 148*b*. As shown in FIG. 3C, the unbound portion 138*b* of the second medial edge 134*b* extends to the second armpit edge 150*b*. As shown in FIGS. 3A and 3D, the bound portion 136*a* of the first medial edge 134*a* and the bound portion 130*a* of the first lateral edge 128*a* are located between the first neckline edge 148*a* and the first armpit edge 150*a*. As shown in FIGS. 3B and 3C, the bound portion 136*b* of the second medial edge 134*b* and the bound portion 130*b* of the second lateral edge 128*b* are located between the second neckline edge 148*b* and the second armpit edge 150*b*.

Figure 4:
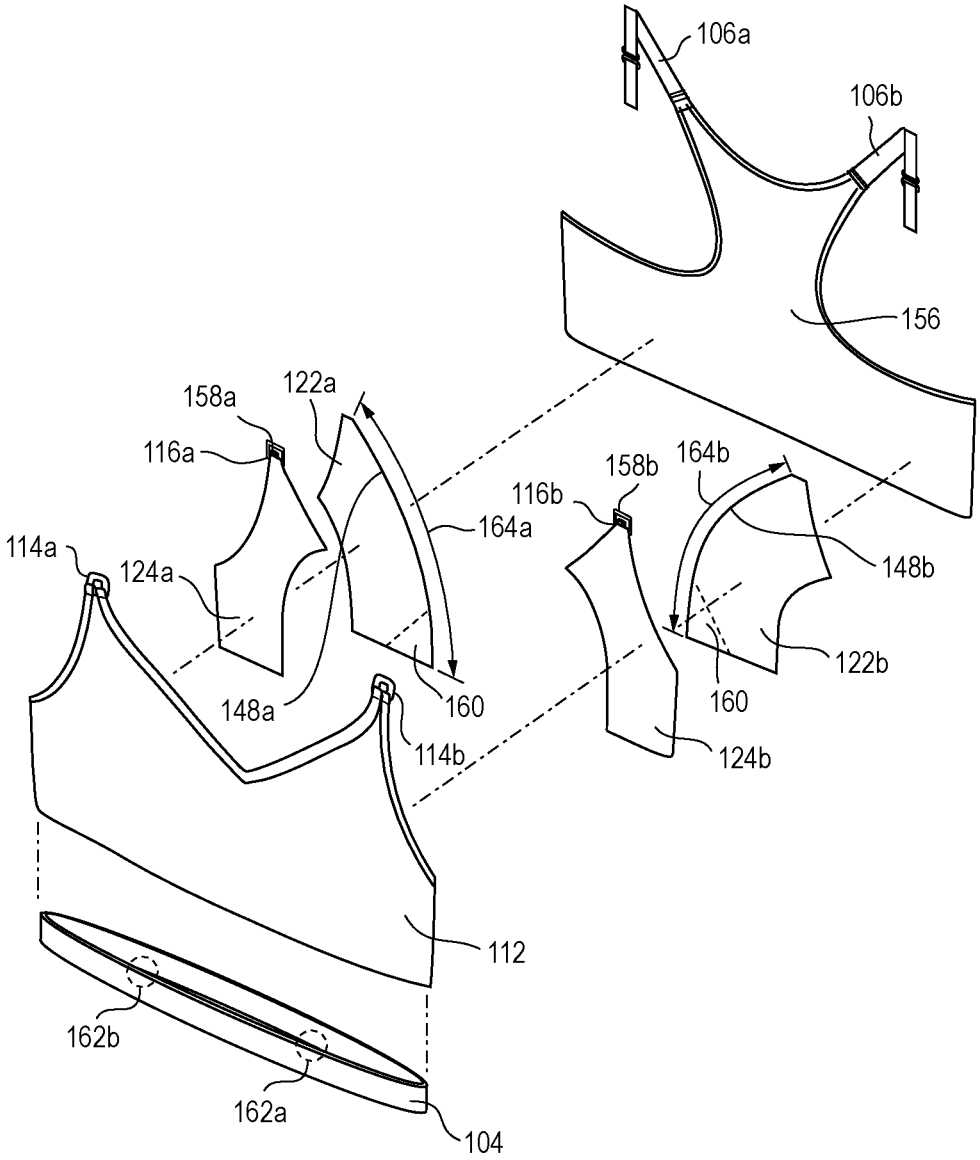
FIG. 4 is an exploded isometric view of the garment of FIGS. 1-3D.

Turning now to FIG. 4, the relative positioning of the bottom band 104, the exterior panel 112, the first medial piece 122*a*, the first lateral piece 124*a*, the second medial piece 122*b*, the second lateral piece 124*b*, and a back 156 is shown. The bottom band 104 is located below the exterior panel 112, the first medial piece 122*a*, the first lateral piece 124*a*, the second medial piece 122*b*, the second lateral piece 124*b*, and the back 156, all of which are permanently connected to the bottom band 104 when the garment 100 is assembled. The exterior panel 112 is located in front of the first medial piece 122*a*, the first lateral piece 124*a*, the second medial piece 122*b*, the second lateral piece 124*b*, and the back 156. As previously discussed, the exterior panel 112 is selectively connectable to a first bra strap 106*a* and a second bra strap 106*b* via rings 114*a* and 114*b* that may be hooked on hooks 116*a* and 116*b* (in this case provided on hoops 158*a* and 158*b*, discussed below). As shown in FIG. 4, the first bra strap 106*a* and the second bra strap 106*b* are permanently connected to the back 156. The back 156 is behind the exterior panel 112, the first medial piece 122*a*, the first lateral piece 124*a*, the second medial piece 122*b*, and the second lateral piece 124*b*.

The first medial piece 122*a* and the first lateral piece 124*a* (which together form the first covering 120*a*) and the second medial piece 122*b* and the second lateral piece 124*b* (which together form the second covering 120*b*) are located between the exterior panel 112 and the back 156. The first lateral piece 124*a* includes a first hoop 158*a* that connects the first lateral piece 124*a* to the first bra strap 106*a*. The second lateral piece 124*b* includes a second hoop 158*b* that connects the second lateral piece 124*b* to the second bra strap 106*b*. The hoops 158*a* and 158*b* shown in FIG. 4 permanently affix the first lateral piece 124*a* and the 124*b* to the first bra strap 106*a* and the second bra strap 106*b*. As a result, the first covering 120*a* and the second covering 120*b* are not configured to be disconnected from the first bra strap 106*a* or the second bra strap 106*b*. In other arrangements not herein depicted, the hoops 158*a* and 158*b* may be configured to be unhooked or unfastened from the first bra strap 106*a* and the second bra strap 106*b*, respectively, such that the first covering 120*a* and/or second covering 120*b* may be disconnected from the first bra strap 106*a* and/or the second bra strap 106*b*.

The first medial piece 122*a* and the first lateral piece 124*a* (which together form the first covering 120*a*) are located in front of the second medial piece 122*b* and the second lateral piece 124*b* (which together form the second covering 120*b*). The first covering 120*a* and the second covering 124*b* are arranged in a surplice neckline. A surplice neckline involves overlapping material arranged to form a neckline, typically a cross-over v-shaped neckline. The first neckline edge 148*a* (shown along the first medial piece 122*a*) extends from the first bra strap 106*a* to the bottom band 104 when the garment 100 is assembled. The second neckline edge 148*b* (shown along the second medial piece 122*b*) extends from the second bra strap 106*b* to the bottom band 104 when the garment is assembled. The first covering 120*a* and the second covering 124*b* are arranged in a surplice neckline and overlap in a central overlap region 160.

The first neckline edge 148*a* connects to the bottom band 104 at a first location 162*a*, and the second neckline edge 148*b* connects to the bottom band at a second location 162*b*. The first neckline edge 148*a* has a first length 164*a*, and the second neckline edge 148*b* has a second neckline length 164*b*. The neckline lengths 148*a* and 148*b* may be the same or different. The exterior panel 112 is configured to cover both the first neckline edge 148*a* and the second neckline edge 148*b* when connected to the first bra strap 106*a* and the second bra strap 106*b*.

Figure 5:
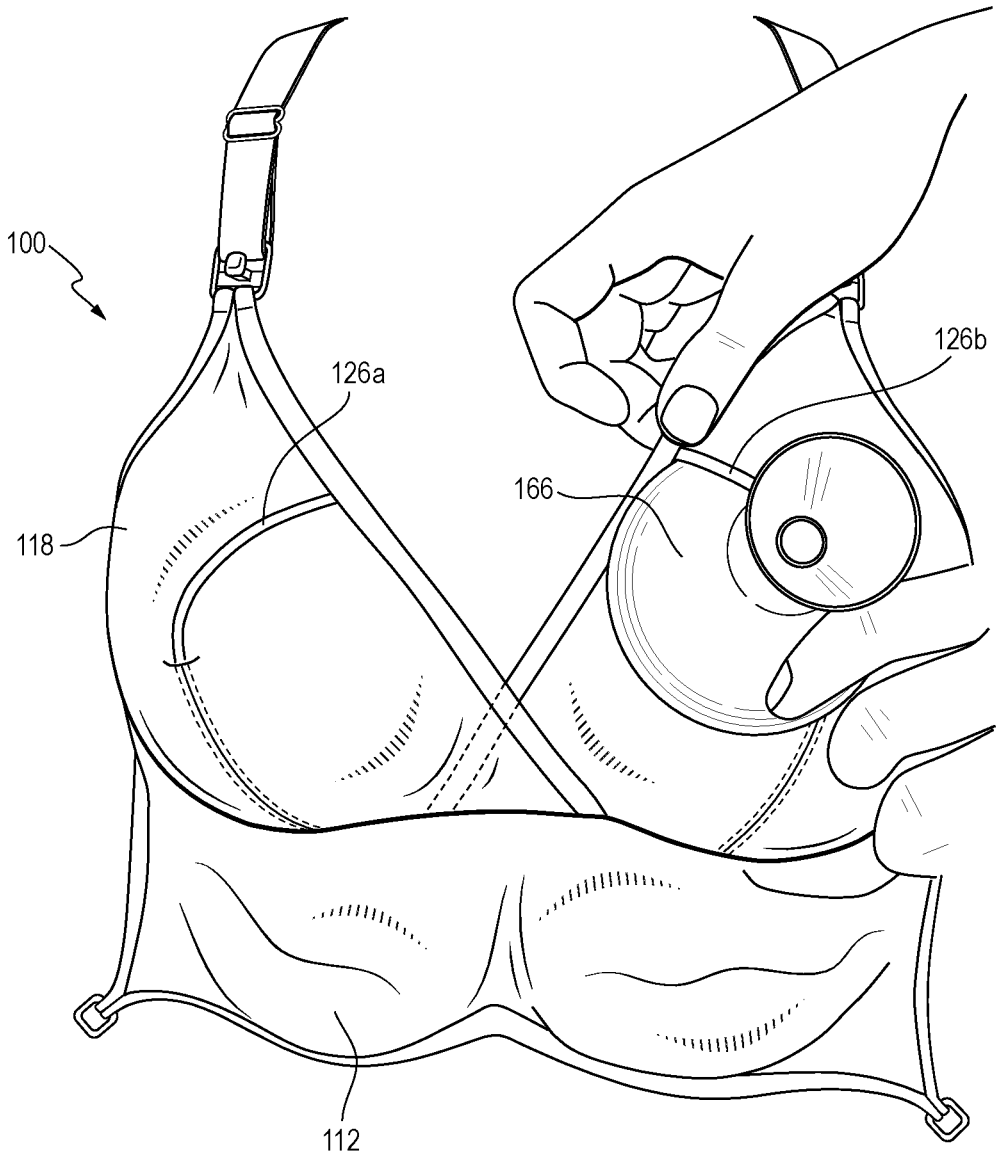
FIG. 5 is a perspective view of the garment of FIGS. 1-4 on a wearer with a breast shield being inserted into the interior panel.

FIG. 5 shows the garment 100 with the exterior panel 112 pulled down such that the interior panel 118 is easily accessible for breast pumping. A breast shield 166 is shown being inserted into the second aperture 126*b*. This is a pumping position, in which the areas 142*b* and 144*b* in the overlapping region 146*b* of the second covering 120*b* (shown in FIGS. 3B and 3C) move relative to one another to permit insertion of the breast shield 166 through the second aperture 126*b*. Although not depicted, the areas 142*a* and 144*a* in the overlapping region 146*a* of the first covering 120*a* (shown in FIGS. 3A and 3D) are also configured to move relative to one another to permit insertion of a breast shield, such as breast shield 166, through the first aperture 126*a*.

Figure 6:
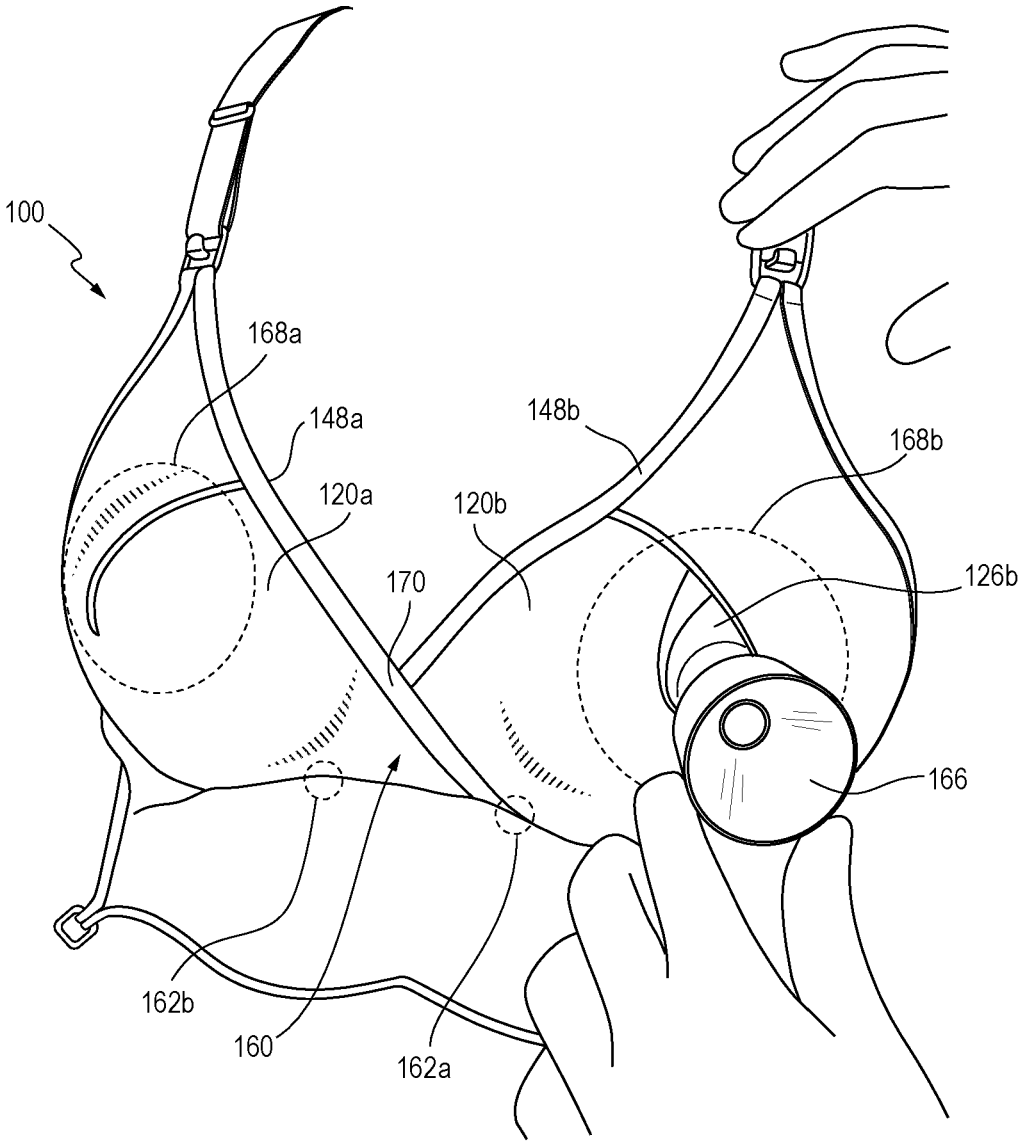
FIG. 6 is a perspective view of the garment of FIGS. 1-5 on a wearer after the breast shield has been fully inserted into the interior panel.

FIG. 6 then shows the garment 100 once the breast shield 166 has been fully inserted into the second aperture 126*b*. As shown in a dotted line, the second covering 120*b* includes a second breast shield support area 168*b* surrounding the second aperture 126*b*. This is the area of the second covering 120*b* that contacts and/or covers the breast shield 166 and holds the breast shield 166 against the breast of the wearer 102. Although a breast shield is not in place in the first covering 120*a*, the first covering 120*a* also includes a first breast shield support area 168*a* that surrounds the first aperture 126*a* and contacts and/or covers a breast shield, such as breast shield 166, when inserted through aperture 126*a*.

As shown in FIG. 6, the first neckline edge 148*a* crosses over the second neckline edge 148*b* at a neckline intersection 170. The central overlap region 160 is created between the first location 162*a* where the first neckline edge 148*a* connects to the bottom band 104, the second location 162*b* where the second neckline edge 148*b* connects to the bottom band 104, and the neckline intersection 170. In order to avoid interfering with the seal formed between a breast shield and a breast of the wearer, the central overlap region 160 does not intersect the first breast shield support area 168*a* or the second breast shield support area 168*b*. The first location 162*a* is medial to the bound portion 130*b* of the second lateral edge 128*b* and the bound portion 136*b* of the second medial edge 134*b* (shown in FIGS. 3A and 3D). The second location 162*b* is medial to the bound portion 130*a* of the first lateral edge 128*a* and the bound portion 136*a* of the first medial edge 134*a* (shown in FIGS. 3B and 3C).

Figure 7:
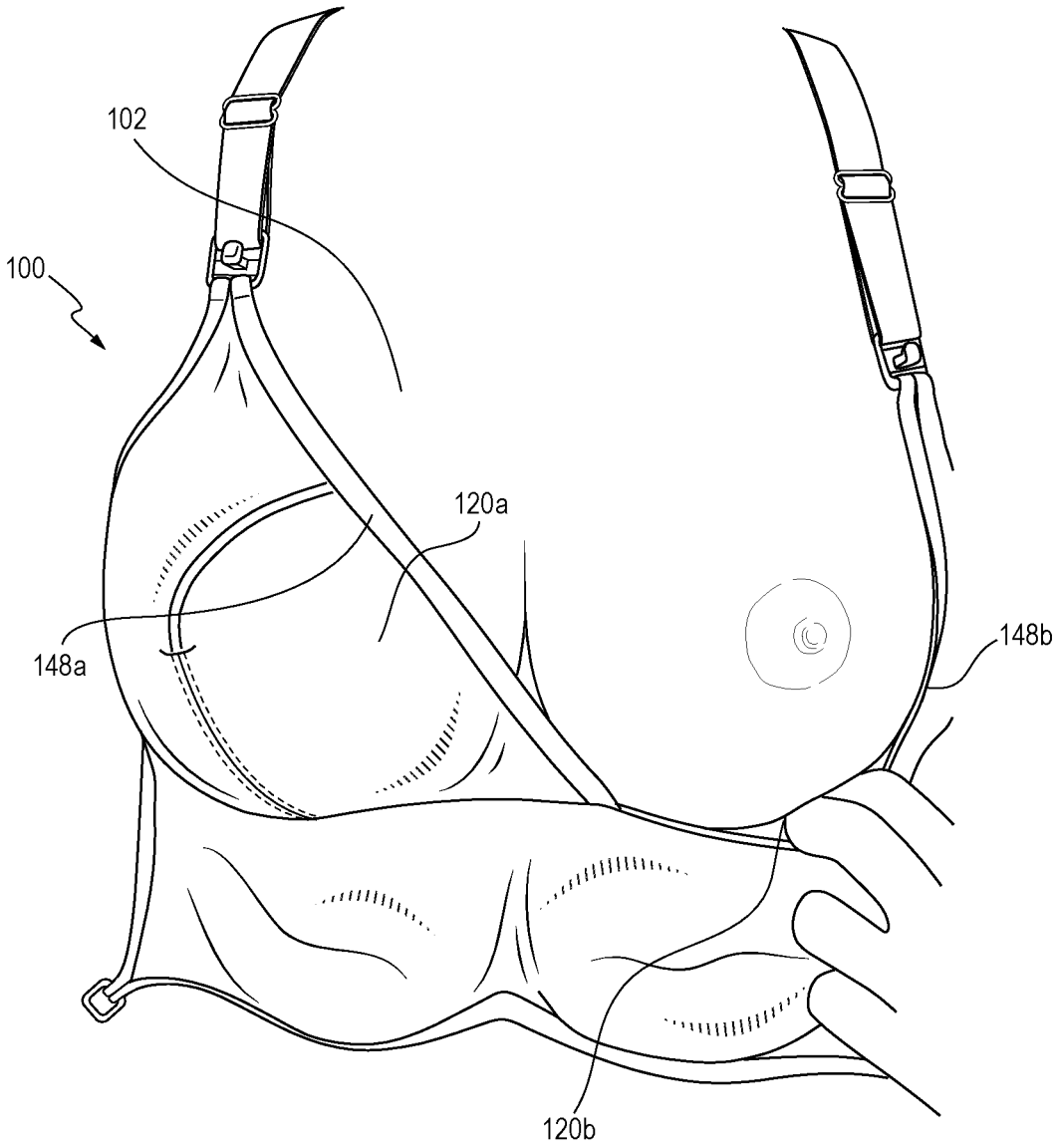
FIG. 7 is a perspective view of the garment of FIGS. 1-6 on a wearer with one side of the garment in a nursing position.

Turning now to FIG. 7, the garment 100 is shown on a wearer 102 in a nursing position. In particular, the second neckline edge 148*b* is pulled down underneath a breast of the wearer 102 to allow an infant to nurse. Both the first neckline edge 148*a* and the second neckline edge 148*b* have respective lengths 164*a* and 164*b* (shown in FIG. 4) that provide freedom of motion to move from the covered position to the nursing position. As shown, the first covering 120*a* is in a covered position, and the second covering 120*b* is in a nursing position. The first neckline edge 148*a* and the second neckline edge 148*b* must be able to move over a breast of the wearer 102 from the covered position to the nursing position below the breast of the wearer 102. Elastic may be sewn into the first neckline edge 148*a* and/or the second neckline edge 148*b* to provide flexibility and resilience for transitioning between the covered position and the nursing position.

Figure 8:
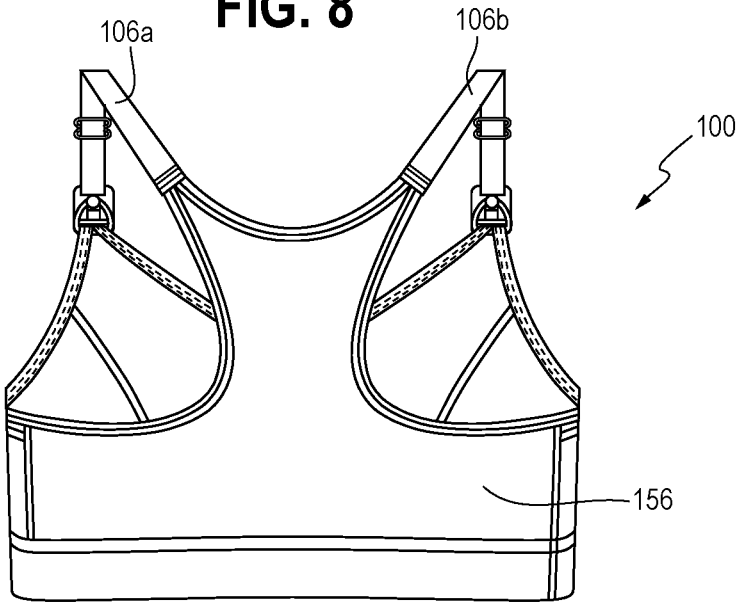
FIG. 8 is a back view of the garment of FIGS. 1-7.

FIG. 8 depicts the garment 100 from a back view in which the back 156 is visible. The back 156 may have the shape shown. Alternately, the back 156 may have a different shape. For example, the back 156 could be a narrow rectangular strip of material connected parallel to the bottom band 156. Some arrangements may not include a back 156 at all, in which case the first bra strap 106*a* and the second bra strap 106*b* would connect directly to the bottom band 104.

Figure 9:
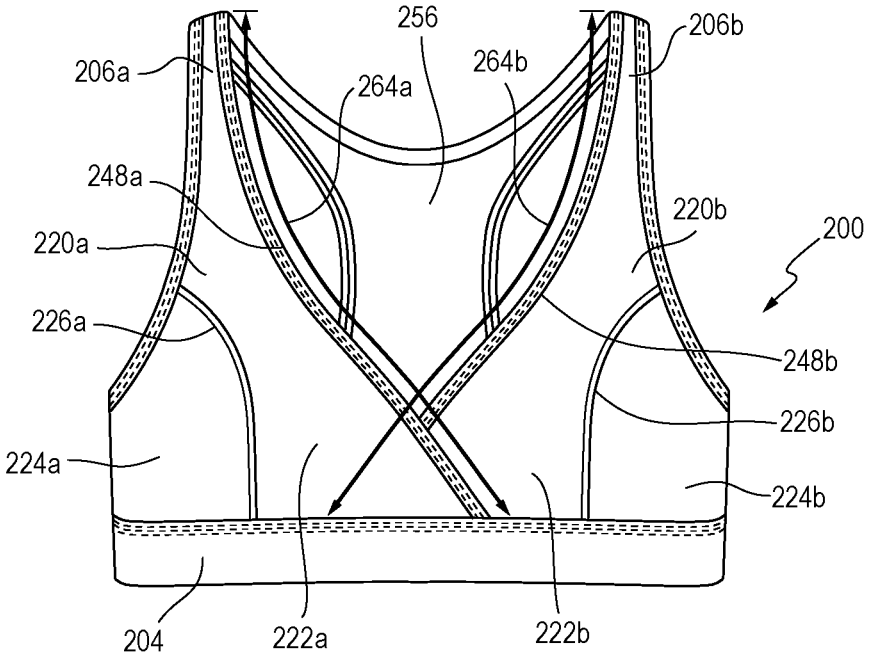
FIG. 9 is a front view of a second arrangement of a multipurpose nursing and pumping garment.
Figure 10:
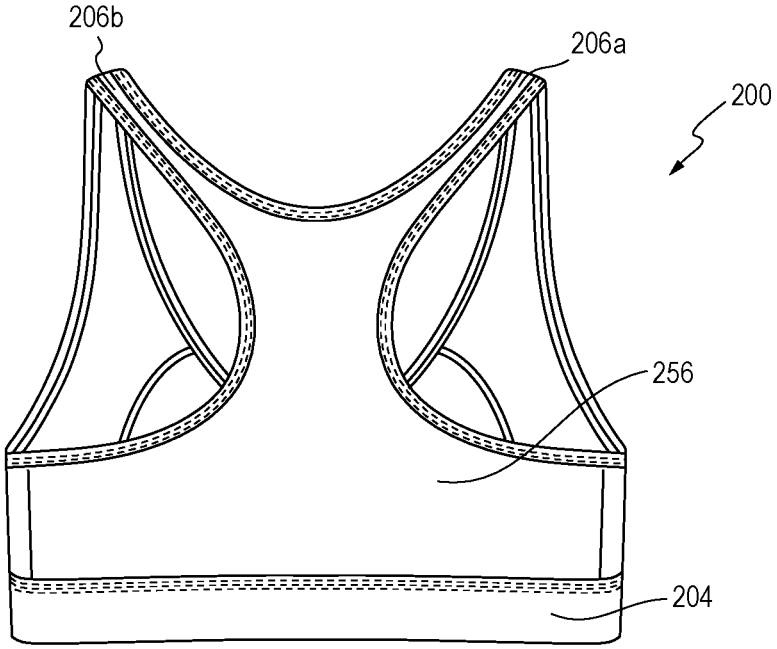
FIG. 10 is a back view of a second arrangement of the garment of FIG. 9.

FIGS. 9 and 10 depict an alternative arrangement of a multipurpose pumping and nursing garment 200. As with garment 100, the garment 200 includes a bottom band 204, a first bra strap 206*a*, a second bra strap 206*b*, a first covering 220*a*, a second covering 220*b*, and a back 256. The first covering 220*a* includes a first medial piece 222*a*, a first lateral piece 224*a*, and a first aperture 226*a*. The second covering 220*b* includes a second medial piece 222*b*, a second lateral piece 224*b*, and a second aperture 226*b*. Unlike the garment 100, the garment 200 does not have an exterior panel 112. Further, the first bra strap 106*a* and the second bra strap 106*b* lack a hook, slider, or other connection piece. Instead, as shown in FIGS. 9 and 10, the first bra strap 206*a* and the second bra strap 206*b* are integral with or permanently affixed to the first covering 220*a*, the second covering 220*b*, and/or the back 256. In this way, the garment 200 more closely resembles a sports bra than a regular bra.

The first covering 220*a* has a first neckline edge 248*a* that extends from the first bra strap 206*a* to the bottom band 204, and the second covering 220*b* has a second neckline edge 248*b* that extends from the second bra strap 206*b* to the bottom band 204. The first neckline edge 248*a* has a length 264*a*, and the second neckline edge 248*b* has a length 264*b*. The lengths 264*a* and 264*b* provide freedom of motion to move the first neckline edge 248*a* and the second neckline edge 248*b*, respectively, from a covered position to a nursing position. Elastic may be sewn into the first neckline edge 248*a* or the second neckline edge 248*b*.

Figure 11A:
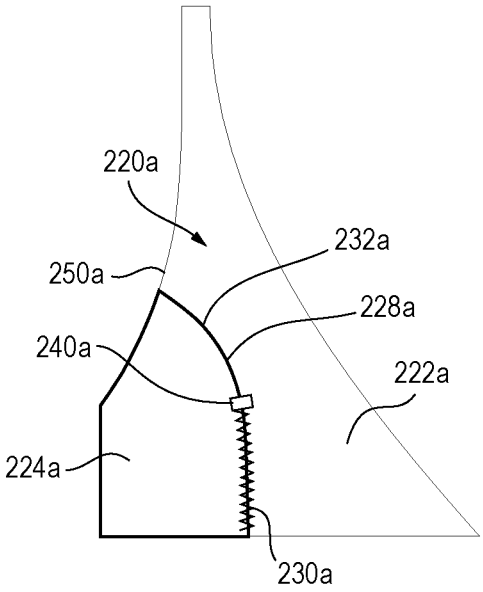
FIG. 11A is a front view of a first covering of the garment of FIGS. 9 and 10 emphasizing the full shape of a first lateral piece of the first covering.
Figure 11B:
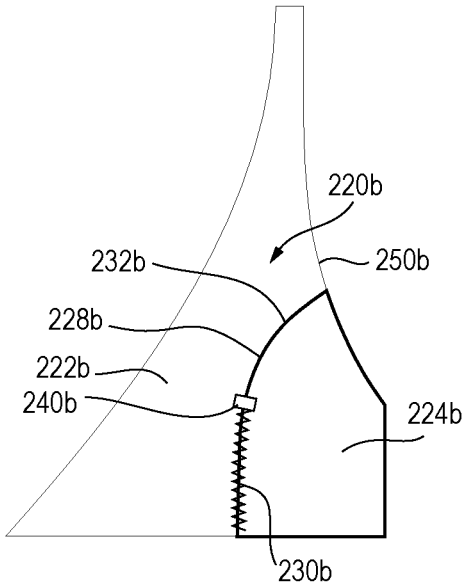
FIG. 11B is a front view of a second covering of the garment of FIGS. 1 and 2 emphasizing the full shape of a first lateral piece of the second covering.

FIGS. 11A and 11B show, respectively, the first covering 220*a* and the second covering 220*b* from a front view. The front view shows the exterior of the garment 200 that would be visible when worn. In FIGS. 11A and 11B, the full shapes of the first lateral piece 224*a* and the second lateral piece 224*b* are emphasized. The first lateral piece 224*a* has a first inner edge 228*a*, and the second lateral piece 224*b* has a second lateral edge 228*b*. The first inner edge 228*a* and the second inner edge 228*b* include, respectively, a bound portion 230*a* and a bound portion 230*b* that are sewn, adhered, or otherwise connected, respectively, to the first medial piece 222*a* and the second medial piece 222*b* (as shown schematically by the zig-zag line). The first inner edge 228*a* and the second inner edge 228*b* also include, respectively, an unbound portion 232*a* and an unbound portion 232*b* that create in part, respectively, the first aperture 226*a* and the second aperture 226*b*. The unbound portions 232*a* and 232*b* of the first inner edge 228*a* and the second inner edge 228*b*, respectively, have a curved shape and ultimately connect, respectively, to first armpit edge 250*a* of the first covering 220*a* and second armpit edge 250*b* of the first covering 220*a*.

Figure 11C:
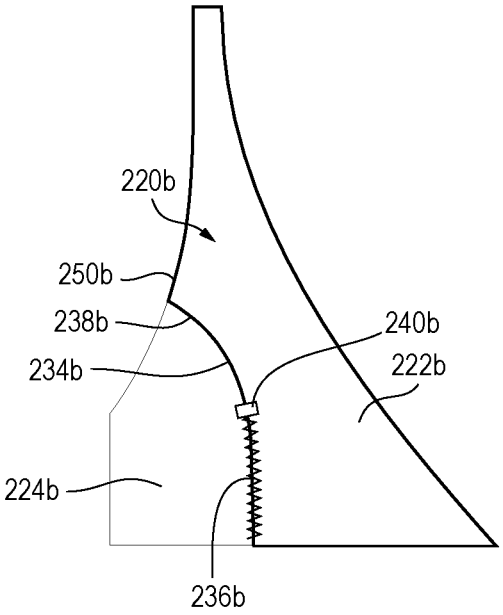
FIG. 11C is a back view of the second covering of the garment of FIGS. 9 and 10 emphasizing the full shape of a second medial piece of the second covering.
Figure 11D:
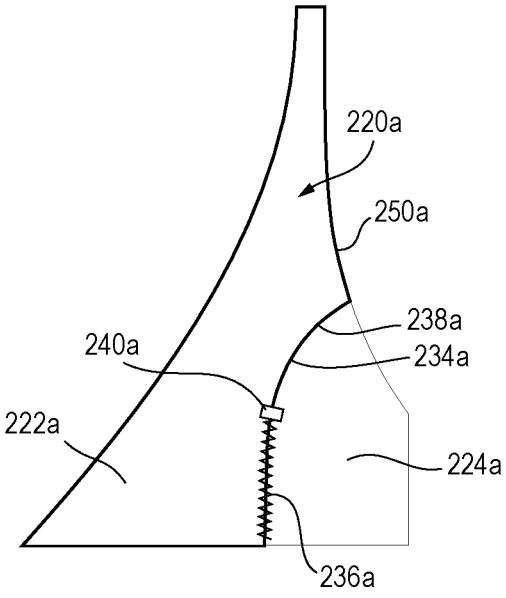
FIG. 11D is a back view of the first covering of the garment of FIGS. 9 and 10 emphasizing the full shape of a first medial piece of the first covering.

FIGS. 11C and 11D show, respectively, the second covering 220*b* and the first covering 220*a* from a back view. The back view shows the interior of the garment 200 that would be visible if the garment 200 were flipped inside out. In FIGS. 11C and 11D, the full shapes of the first medial piece 222*a* and the second medial piece 222*b* are emphasized. The first medial piece 222*a* has a first internal edge 234*a*, and the second medial piece 222*b* has a second internal edge 234*b*. The first internal edge 234*a* and the second internal edge 234*b* include, respectively, a bound portion 236*a* and a bound portion 236*b* that are sewn, adhered, or otherwise connected, respectively, to the first lateral piece 224*a* and the second lateral piece 224*b*. The first internal edge 234*a* and the second internal edge 234*b* also include, respectively, an unbound portion 238*a* and an unbound portion 238*b* that create in part, respectively, the first aperture 226*a* and the second aperture 226*b*. The unbound portions 238*a* and 238*b* of the first internal edge 234*a* and the second internal edge 234*b*, respectively, have a curved shape complementary and adjacent to the curved shape of the unbound portions 232*a* and 232*b* of the first inner edge 228*a* and the second inner edge 228*b*. The unbound portions 238*a* and 238*b* of the first internal edge 234*a* and the second internal edge 234*b* ultimately connect, respectively, to first armpit edge 250*a* of the first covering 220*a* and second armpit edge 250*b* of the first covering 220*a*.

As shown in FIGS. 11A-11D, the bound portion 236*a* of the first internal edge 234*a* is adjacent and connected to the bound portion 230*a* of the first inner edge 228*a*. Likewise, the bound portion 236*b* of the second internal edge 234*b* is adjacent and connected to the bound portion 130*b* of the second lateral edge 128*b*. The bound portion 236*a* is sewn, adhered, or otherwise fastened to the bound portion 230*a* such that the overlap between the first medial piece 222*a* and the first lateral piece 224*a* where the bound portion 236*a* is connected to the bound portion 230*a* is limited to only the amount of overlap needed to sew, adhere, or otherwise fasten the bound portions 236*a* and 230*a* to each other. Likewise, the bound portion 236*b* is sewn, adhered, or otherwise fastened to the bound portion 230*b* such that the overlap between the second medial piece 222*b* and the second lateral piece 224*b* is limited to only the amount of overlap needed to sew, adhere, or otherwise fasten the bound portions 236*b* and 230*b* to each other.

As shown in FIGS. 11A and 11D, a first bar tack 240*a* may be provided where the bound portion 236*a* of the first internal edge 234*a* and the bound portion 230*a* of the first inner edge 228*a* end and the unbound portion 238*a* of the first internal edge 234*a* and the unbound portion 232*a* of the first inner edge 228*a* begin. As shown in FIGS. 11B and 110, a second bar tack 240*b* may be provided where the bound portion 236*b* of the second internal edge 234*b* and the bound portion 230*b* of the second inner edge 228*b* end and the unbound portion 238*b* of the second internal edge 234*b* and the unbound portion 232*b* of the second inner edge 228*b* begin. The first bar tack 240*a* and the second bar tack 240*b* may resist stress and wear caused from breast shields being inserted, supported, and removed from, respectively, first aperture 226*a* and second aperture 226*b*.

Figure 12:
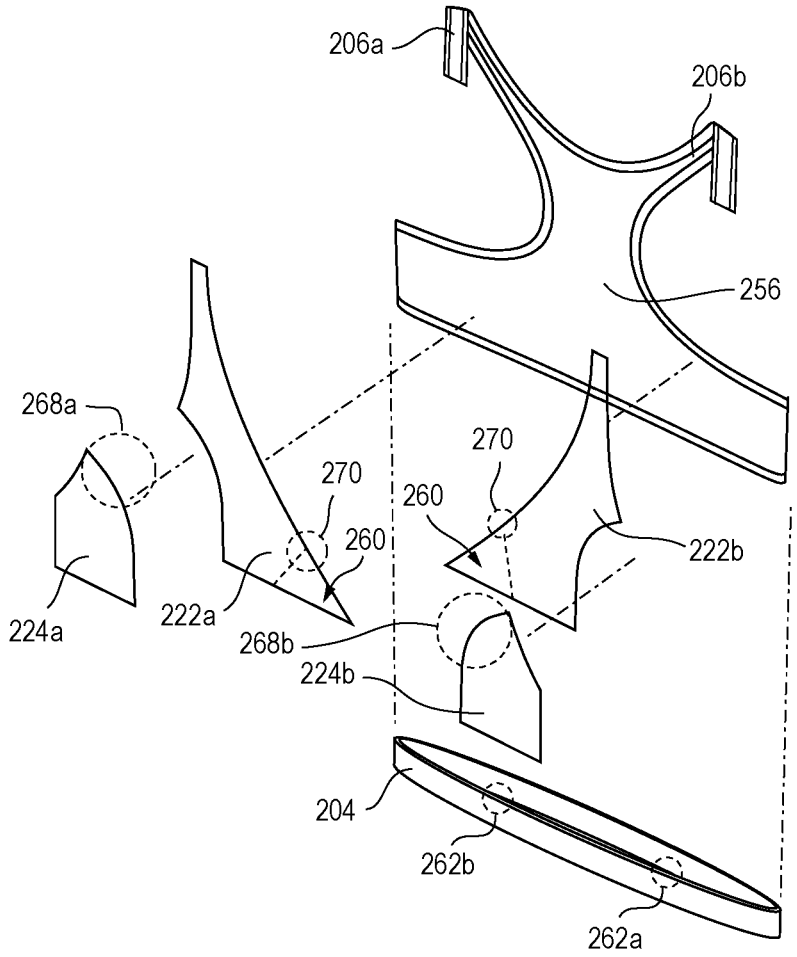
FIG. 12 is an exploded view of the garment of FIGS. 9-11D.

Turning now to FIG. 12, the relative positioning of the bottom band 204, the first medial piece 222*a*, the first lateral piece 224*a*, the second medial piece 222*b*, the second lateral piece 224*b*, and a back 256 is shown. The bottom band 204 is located below the first medial piece 222*a*, the first lateral piece 224*a*, the second medial piece 222*b*, the second lateral piece 224*b*, and the back 256, all of which are permanently connected to the bottom band 104 when the garment 200 is assembled.

The first neckline edge 248*a* connects to the bottom band 204 at a first location 262*a*, and the second neckline edge 248*b* connects to the bottom band 204 at a second location 262*b*. The first neckline edge 248*a* crosses over the second neckline edge 248*b* at a neckline intersection 270. The central overlap region 260 is created between the first location 262*a* where the first neckline edge 248*a* connects to the bottom band 204, the second location 262*b* where the second neckline edge 248*b* connects to the bottom band 204, and the neckline intersection 270. In order to avoid interfering with the seal formed between a breast shield and a breast of the wearer, the central overlap region 260 does not intersect a first breast shield support area 268*a* or a second breast shield support area 268*b*. The first location 262*a* is medial to the bound portion 230*b* of the second inner edge 228*b* and the bound portion 236*b* of the second internal edge 234*b* (shown in FIGS. 11B and 110). The second location 262*b* is medial to the bound portion 230*a* of the first inner edge 228*a* and the bound portion 236*a* of the first internal edge 234*a* (shown in FIGS. 11A and 11D).

While the present disclosure has been described with respect to certain embodiments, it will be understood that variations may be made thereto that are still within the scope of the appended claims. Additionally, while a particularly-preferred embodiment is illustrated in the drawings of the present disclosure, it will be understood that the functional features disclosed and claimed herein can be accomplished in devices that differ ornamentally from these drawings, and ornamental features of the drawings are not dictated by function.

What is claimed is:

1. A garment comprising:

a bottom band;

a first bra strap and a second bra strap;

an interior panel connected to the bottom band, the first bra strap, and the second bra strap, and including a first covering and a second covering;

an exterior panel permanently connected to the bottom band and selectively connectable to the first bra strap and the second bra strap, the exterior panel arranged to selectively cover the interior panel;

the first covering including a first medial piece and a first lateral piece, the first medial piece having a first medial edge having a bound portion and an unbound portion, the first lateral piece having a first lateral edge having a bound portion and an unbound portion, the bound portion of the first medial edge adjacent and connected to the bound portion of the first lateral edge, the unbound portion of the first medial edge extending across the first lateral piece and the unbound portion of the first lateral edge extending across the first medial piece, a first aperture is created between the first lateral edge and the first medial edge; and a second covering including a second medial piece and a second lateral piece, the second medial piece having a second medial edge having a bound portion and an unbound portion, the second lateral piece having a second lateral edge having a bound portion and an unbound portion, the bound portion of the second medial edge adjacent and connected to the bound portion of the second lateral edge, the unbound portion of the second medial edge extending across the second lateral piece and the unbound portion of the second lateral edge extending across the second medial piece, a second aperture being created between the second lateral edge and the second medial edge, the first covering including a first neckline edge and a first armpit edge, the unbound portion of the first medial edge of the first medial piece extending to the first armpit edge, and the unbound portion of the first lateral edge of the first lateral piece extending to the first neckline edge; and the second covering including a second neckline edge and a second armpit edge, the unbound portion of the second medial edge of the second medial piece extending to the first armpit edge, and the unbound portion of the second lateral edge of the second lateral piece extending to the second neckline edge.

2. The garment of claim 1, the bound portion of the first medial edge and the bound portion of the first lateral edge located between the first neckline edge and the first armpit edge; and the bound portion of the second medial edge and the bound portion of the second lateral edge located between the second neckline edge and the second armpit edge.

3. The garment of claim 1, further comprising a first bar tack at the bottom of the first aperture where the bound portion of the first lateral edge and the bound portion of the first medial edge end and the unbound portion of the first lateral edge and the unbound portion of the first medial edge begin; and a second bar tack at the bottom of the second aperture where the bound portion of the second lateral edge and the bound portion of the second medial edge end and the unbound portion of the second lateral edge and the unbound portion of the second medial edge begin.

4. The garment of claim 1, wherein an area of the first medial piece adjacent the unbound portion of the first medial edge overlaps an area of the first lateral piece adjacent the unbound portion of the first lateral edge to form an overlapping region of the first covering; and wherein an area of the second medial piece adjacent the unbound portion of the second medial edge overlaps an area of the second lateral piece adjacent the unbound portion of the second lateral edge to form an overlapping region of the second covering.

5. The garment of claim 4, wherein the area of the first medial piece and the area of the first lateral piece in the overlapping region of the first covering lay adjacent to one another when the first covering is in a covered position such that the first aperture is not visible in the covered position; and wherein the area of the second medial piece and the area of the second lateral piece in the overlapping region of the second covering lay adjacent to one another when the second covering is in a covered position such that the second aperture is not visible in the covered position.

6. The garment of claim 5, wherein, in a pumping position, the areas in the overlapping region of the first covering move relative to one another to permit insertion of a breast shield through the first aperture; and wherein, in the pumping position, the areas in the overlapping region of the second covering move relative to one another to permit insertion of a breast shield through the second aperture.

* * * * *